United States Patent [19]

Matsumoto et al.

[11] 4,422,060

[45] Dec. 20, 1983

[54] D.C. ELECTROMAGNETIC ACTUATOR

[75] Inventors: Norio Matsumoto, Kumagaya; Teruo Umehara, Hanyu, both of Japan

[73] Assignee: Hitachi Metals, Ltd., Tokyo, Japan

[21] Appl. No.: 339,653

[22] Filed: Jan. 15, 1982

[30] Foreign Application Priority Data

Aug. 21, 1981 [JP] Japan ..... 56-123955[U]

[51] Int. Cl.[3] ..... H01F 7/08

[52] U.S. Cl. ..... 335/256; 335/266

[58] Field of Search ..... 335/266, 267, 268, 256, 335/255, 260, 262

[56] References Cited

U.S. PATENT DOCUMENTS 3,149,255 9/1964 Trench ..... 310/30
3,503,022 3/1970 Burdett ..... 335/266
4,067,541 1/1978 Hunter ..... 335/260
4,233,585 11/1980 Sugimoto et al. ..... 335/255

*Primary Examiner*—Harold Broome
*Attorney, Agent, or Firm*—Antonelli, Terry & Wands

[57] ABSTRACT

An actuator driven by D.C. power suitable for use in actuating automobile door locking device. The actuator has a yoke apparatus defining a space, two annular solenoid coils supported and received by the yoke apparatus and adapted to be energized simultaneously such that poles of the same polarity appear at the adjacent ends of the coils, and moving means reciprocatably disposed in the space of the yoke apparatus. The moving means includes an axially magnetized permanent magnet carried by a shaft and a pair of magnetic members attached to both axial ends of the permanent magnet.

17 Claims, 9 Drawing Figures

D.C. ELECTROMAGNETIC ACTUATOR

BACKGROUND OF THE INVENTION

1. Field of the Invention

The present invention relates to an actuator having a reciprocatable moving means, suitable for use particularly but not exclusively in a device for locking and unlocking automobile doors through the manipulation of a switch. Still more particularly, the invention is concerned with an actuator of magnet moving type.

2. Description of the Prior Art

Door locking devices adapted to lock and unlock automobile doors by means of an electric switch have been already installed on high grade automobiles. Various types of locking devices of the kind described have been proposed hitherto. A typical example of this device is disclosed in "Automotive Engineer's Handbook" (ed. by Society of Automotive Engineers of Japan).

This device has a rod attached to the shaft of an actuator and fixed to a hook provided in each door. The hook is adapted to be brought into and out of engagement with a hinge provided in the body of the automobile in accordance with the reciprocative movement of the shaft, thereby to lock and unlock the door.

A torsion bar and a spiral spring are attached to the hook so that there is one peak point where the shaft encounters the maximum load in its single stroke from the locking state to the unlocking state or vice versa. Once the shaft is moved to one of the full lock or full unlock states beyond the above-mentioned peak, it cannot be returned to the other state naturally.

Thus, the torsion bar and the spiral spring in combination provide a fail-safe system in the door locking mechanism. Usually, the distance of movement of the shaft until the shaft gets over the peak point, i.e. the distance between the end of each stroke and the peak point in the same stroke is about 2~4 mm which is less than a half of the stroke length.

In order that the shaft is moved beyond the peak point, the maximum thrust generated by the actuator has to be about 24.5 N or greater. It is also necessary that the maximum stroke has to be produced in the initial period of the movement of the shaft. Namely, it is necessary that the actuator has such stroke-thrust characteristics that the thrust takes the maximum value in the initial period of the stroke and the level of the thrust is gradually decreased as the travel of the shaft is increased.

There are various types of mechanism for actuating the shaft reciprocatingly. For instance, the aforementioned "Automotive Engineer's Handbook" shows a solenoid type actuator at FIG. 2-398, Section 16.2, Chapter 2. This solenoid type actuator, however, has the following disadvantages although it exhibits a good respondence. This actuator is usually composed of a movable member or a plunger, two separate solenoid coils spaced in the axial direction and surrounding the plunger concentrically, and a yoke apparatus accommodating the coils. These two coils are adapted to be energized alternately so that the plunger is moved in one and the other direction by the electromagnetic attracting force acting between the plunger and the coils. Thus, in the conventional solenoid type actuator, it is necessary to use two solenoid coils although only one of them is used in each stroke. In addition, each coil is required to produce a magnetomotive force large enough to actuate the plunger. This means that each coil has to have a large size. In addition, in this type of actuator, the thrust is increased as the travel of the plunger is increased and the plunger has to be stopped forcibly at the end of its stroke, so that a large impact is produced accompanying with a large noise. In order to absorb this noise, a noise absorbing member is attached to each end surface of the yoke member and/or each end surface of the plunger. In consequence, the stroke length for the production of the thrust is increased resulting in a reduced level of the thrust. The volume and weight of the actuator are also increased undesirably.

Solenoid type actuator having a moving magnet has been put into practical use already. For instance, the specification of U.S. Pat. No. 3,149,255 (Trench et al.) shows at FIG. 9 an electromagnetic motor having a similar construction to the actuator of the present invention. This electromagnetic motor, however, is intended specifically for use as swing motors for air pumps or for use as vibrators or the like apparatus adapted to be driven by commercial A.C. power, and is not to intended for the operation with D.C. power which is used for driving the actuator for an automobile door locking device. In addition, in this electromagnetic motor, the magnetic piece of the movable member is disposed in axial alignment with the magnetic gap formed between the movable member and the yoke apparatus, in order to make an efficient use of the magnetic flux of the permanent magnet.

Japanese Utility Model Laid-open No. 54317/1979 discloses an actuator having a reciprocatable movable member. This actuator also is intended for use in pumps, vibration machines or the like apparatus driven by A.C. power, and is adapted to produce a substantially constant thrust over its entire stroke.

As has been stated, the actuators proposed and used hitherto are still unsatisfactory as the actuator for an automobile door locking device.

SUMMARY OF THE INVENTION

Accordingly, an object of the invention is to provide an actuator having such stroke-thrust characteristics that the thrust takes the maximum level at the initial period of the operation and the level of the thrust is gradually decreased as the travel of the movable member is increased.

Another object of the invention is to provide an actuator having reduced size and weight.

These and other objects, features and advantages of the invention will become clear from the following description of the preferred embodiment taken in conjunction with the accompanying drawings.

DETAILED DESCRIPTION OF THE PREFERRED EMBODIMENTS

Figure 1:
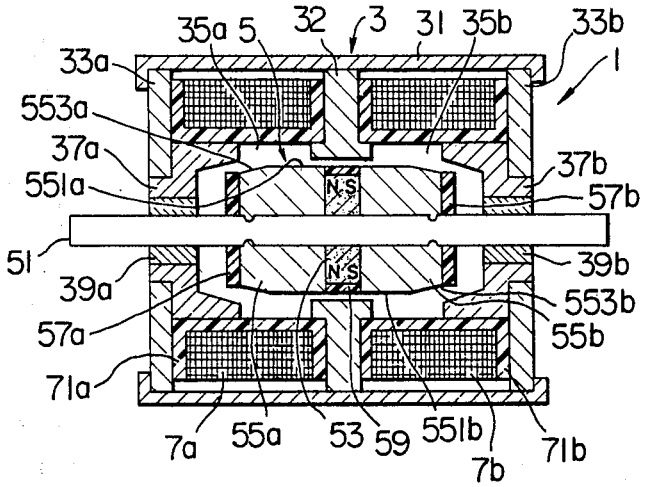
FIG. 1 is a longitudinal sectional view of an actuator for a door locking device, constructed in accordance with an embodiment of the invention.

Referring to FIG. 1, an actuator generally designated at a reference numeral 1 has a yoke apparatus 3 and a moving means 5. The yoke apparatus 3 includes a hollow cylindrical yoke member 31 made from a soft magnetic material, an annular center yoke 32 also made from a soft magnetic material and projecting radially inwardly from the inner peripheral surface of the yoke member 31 at a substantially mid portion of the yoke member 31 and a pair of end yoke means having ring-shaped end walls 33*a* and 33*b* made of a soft magnetic material and attached to both ends of the yoke member 31, and end yokes 37*a* and 37*b* made of a soft magnetic material and welded to the end walls 33*a* and 33*b*, the end yokes 37*a* and 37*b* opposing to the center yoke 32 in the axial direction so as to form magnetic gaps 35*a*, 35*b* therebetween.

A pair of annular solenoid coils 7*a* and 7*b* are accommodated by respective coil bobbins 71*a* and 71*b* which serve as insulators. These two annular solenoid coils are disposed in a corresponding one of two halves of the space in the yoke apparatus divided into the two halves by the center yoke 32.

These two coils 7*a* and 7*b* are electrically connected to each other in parallel or series in such a manner that the same polarity appears at the ends of these coils opposing each other.

Figure 3A:
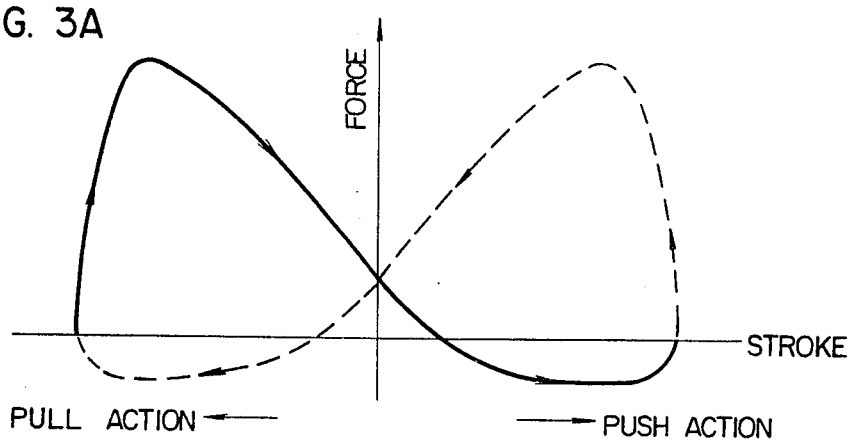
FIG. 3A is a graph showing desirable thrust-stroke characteristics of a spiral spring in an actuator for a door locking device.

The moving means 5 disposed in the space defined by the yoke apparatus 3 includes a shaft 51, a ring-shaped permanent magnet 53 attached on the central portion of the shaft 51 and axially magnetized as illustrated, and magnetic members 55*a* and 55*b* secured on the shaft 51 and attached to both ends of the permanent magnet 53. In addition, as will be clearly understood from FIG. 3, the magnetic members 55*a* and 55*b* have cylindrical portions 551*a* and 551*b* and tapered portions 553*a* and 553*b*, respectively. The end yokes 37*a* and 37*b* are so shaped as to be able to receive the tapered portions 553*a* and 553*b* of the magnetic members 55*a* and 55*b*. The shaft 51 is supported for reciprocative movement by bearings 39*a* and 39*b* provided on the end yokes 37*a* and 37*b*, respectively, so that the moving means 5 can freely reciprocate in the aforementioned space.

The moving means 5 is further provided with noise absorbing members 57*a* and 57*b* made from a plastic or an elastic material secured to the end surfaces of the magnetic members 55*a* and 55*b*, and an annular protect belt 59 made of a plastic or a non-magnetic metal such as aluminum, fitted around the permanent magnet 53.

Modifications of the moving means 5 will be explained with specific reference to FIGS. 6A and 6B. Referring first to FIG. 6A, the moving means 5*a* has the ring-shaped permanent magnet 53 retained substantially on the mid portion of the shaft 51, and magnetic members 55*a* and 55*b* make contact at their one ends with respective end surfaces of the permanent magnet 53. The other end portions of the magnetic members are fixed to the shaft 51 by caulking. In the moving means 5*b* shown in FIG. 6B, an annular spacer 52 made of an elastic material such as rubber or the like is interposed between the inner peripheral surface of the ring-shaped permanent magnet 53 and the outer peripheral surface of the shaft 51. Other portions are materially identical to those shown in FIG. 5A. In this case, by selecting the outside diameter of the spacer 52 to be slightly greater than the inside diameter of the ring-shaped magnet 53, it is possible to absorb to some extent a possible fluctuation of the inside diameter of the permanent magnet 53, so that it is possible to easily and correctly mount the permanent magnet 53 on the shaft 51 concentrically therewith, without using any specific complicated jig. This in turn prevents the permanent magnet from projecting radially outwardly from the outer peripheral surfaces of the magnetic members 55*a* and 55*b*.

The operation of the actuator having the described construction will be explained hereinafter with reference to FIG. 2.

The solenoid coils 7*a*, 7*b* are energized through terminals (not shown) by D.C. power in such a manner that the same polarity appears in the adjacent ends of these coils. Namely, the direct current is supplied such that an S pole appears at the portion 32*c* of the center yoke 32, while N poles appear on the portions 37′*a* and 37′*b* of the end yokes 37*a* and 37*b* facing the center yoke 32. The magnetic flux from the N pole of the permanent magnet 53 of the moving means 5 reaches the S pole of the permanent magnet 53 through the magnetic member 55*a*, magnetic gap 35*a*, solenoid coil 7*a*, center yoke 32, solenoid coil 7*b*, magnetic gap 35*b* and the magnetic member 55*b*. Thus, the magnetic flux define a closed magnetic circuit MC. In consequence, a magnetic repulsive force acts between the magnetic member 55*a* and the portion 37′*a*, while a magnetic attracting force acts between the magnetic member 55*b* and the portion 37′*b*, so that the moving means 5 is moved in the direction indicated by a full-line arrow X in the FIG. 2.

When the polarity of the supply of the direct current to the solenoid coils 7*a*, 7*b* is reversed, the magnetic relation between the portions 37′*a*, 37′*b* and the magnetic members 55*a*, 55*b* is also reversed, so that the moving means 5 is moved in the direction indicated by a chain-line arrow Y.

The thrust acting on the moving means 5 is, needless to say, proportional to the magnetic flux of the permanent magnet 53 and also to the direct current I supplied to the solenoid coils 7*a*, 7*b*, and has a dependency on the variation of the permeance P of the closed magnetic circuit MC. Namely, the thrust is changeable depending on the relative positionings of the magnetic members 55*a*, 55*b*, portions 37′*a*, 37′*b*, opposing portion 32*c* of the center yoke and the permanent magnet 53. Thus, the maximum thrust is obtained at a position of the moving means where the absolute value of the variate $\Delta P$ of the permeance P of the closed magnetic circuit takes the maximum value.

Figure 2:
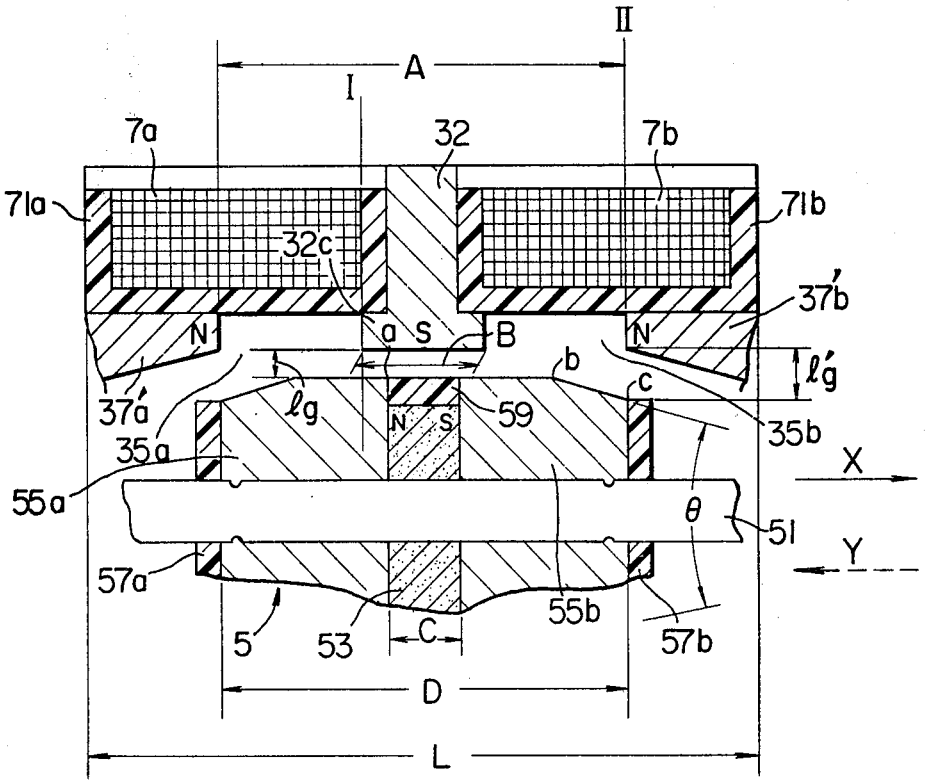
FIG. 2 is a fragmentary enlarged sectional view of an essential part of the actuator shown in FIG. 1.

In order to obtain the maximum thrust, i.e. the maximum variant $\Delta P$, at the initial period of the stroking, it is necessary that the above-mentioned constituents of the actuator are constructed and arranged to meet the following conditions (i) and (ii) simultaneously:

$$D > C \text{ and } A > C \quad \text{(i)}$$

$$B \geqq C \geqq lg \quad \text{(ii)}$$

where, as will be seen from FIG. 2, A represents the axial distance between the opposing surfaces of the portions 37'a and 37'b opposing to the center yoke 32, B represents the axial length of the portion 32c of the center yoke 32 opposing to the moving means 5, C represents the axial distance between the inner ends of the magnetic members at the outer peripheral surface of the moving means 5, D represents the axial distance between the outer ends, i.e. the ends adjacent to the axial ends of the actuator, of the magnetic members 55a and 55b of the moving means 5, and lg represents the length of the radial gap between the opposing portion 32c of the center yoke 32 and the outer peripheral surface of the moving means 5.

In order that the maximum thrust is obtained in the initial period of movement, e.g. within the range of 0 to 5 mm, it is also necessary that the following condition (iii) is met;

$$0 \leqq (L/2)-(B-C)/2 \leqq 5[\text{mm}] \quad \text{(iii)}$$

where, L represents the entire stroke length of the moving means 5.

Figure 3B:
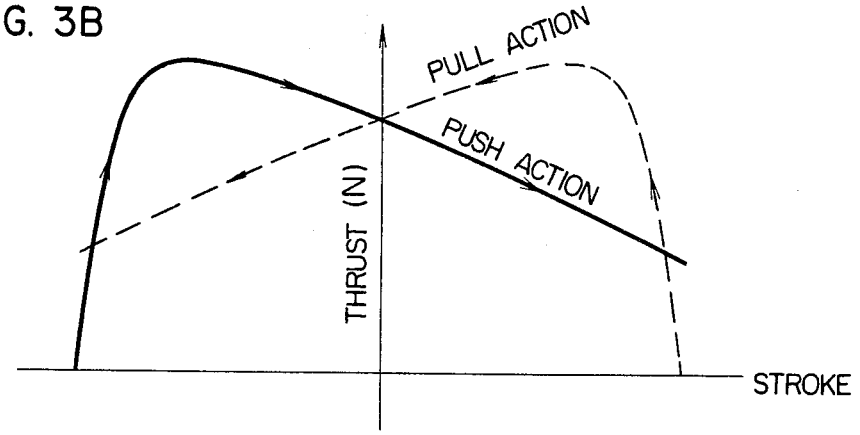
FIG. 3B is a graph showing thrust-stroke characteristics of the actuator shown in FIG. 1.

It is possible to obtain the thrust-stroke characteristics as shown in FIG. 3B by constructing the actuator such that the conditions (i), (ii) and (iii) are satisfied simultaneously.

Figure 3C:
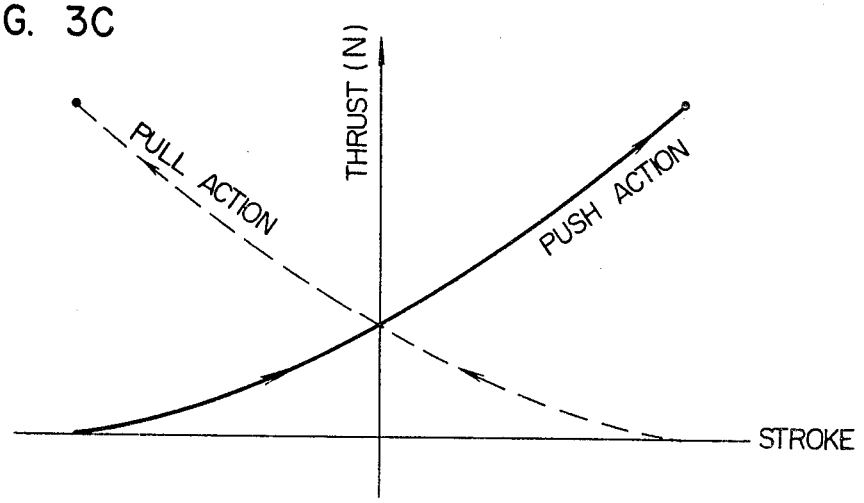
FIG. 3C is a graph showing thrust-stroke characteristics of a typical conventional solenoid type actuator.

In contrast, the conventional solenoid type actuator inevitably exhibits the thrust-stroke characteristics as shown in FIG. 3C.

In the embodiment shown in FIG. 1, the axial end portions of the magnetic members 55a and 55b are tapered at a taper angle $\theta$ such that the diameters are gradually decreased toward the axially outer sides. By varying the taper angle $\theta$, it is possible to further improve the thrust-stroke characteristics shown in FIG. 3B.

More specifically, imagine here three positions of the moving means 5 where the edges of the magnetic members 55a and 55b oppose the edges of the yoke apparatus: namely a first position where the line I aligns with the edge (a), a second position where the line II aligns with the edge (b) and a third position where the line II aligns with the edge (c). Representing the thrust exerted at these three positions by Fa, Fb and Fc, respectively, it is desirable that the following condition is met in order to further improve the characteristics shown in FIG. 3B.

$$Fa \geqq Fc \geqq Fb$$

As stated before, the magnitude of the thrust depends on the absolute value of the variate $\Delta P$ of the permeance P of the closed magnetic circuit. From this fact, it is derived that a greater thrust is obtained in the portion where the length of the gap constituting the magnetic circuit is small than in the portion where the length of the gap is large.

Referring again to FIG. 2, the gap length lg in the first position is smaller than the gap length l'g in the third position. This means that the condition $Fa > Fc$ is met. In the second position, the tapered portion of the magnetic member 55b is accommodated almost fully by the end yoke 37b, so that the variate $\Delta P$ of the permeance P of the magnetic circuit MC is decreased. Therefore, in the second position, the thrust is smaller than that produced in the first position, although the gap lengths are equal. The condition of $Fc > Fb$, therefore, is met also.

Experiments by the inventors shows that the condition of $Fa \geqq Fc \geqq Fb$ is satisfied when the taper angle $\theta$ is selected to fall between 5° and 25°. If the taper angle $\theta$ is greater than 25°, the magnetic gap length lg is much greater than lg ($lg \leqq l'g$), so that the thrust Fa becomes much larger than the thrust Fc ($Fc << Fa$) while the thrust Fb becomes substantially equal to the thrust Fc ($Fc \approx Fb$).

To the contrary, when the taper angle $\theta$ is selected to be smaller than 5°, a relation $lg \approx l'g$ exists between the gap lengths lg and l'g, so that the thrusts Fa and Fc are substantially equal ($Fa \approx Fc$), while the thrust Fb is substantially null ($Fa \approx 0$).

In the actuator heretofore described, permanent magnet 53 of the moving means 5 is de-magnetized by the de-magnetizing force generated by the solenoid coils 7a, 7b. It is, therefore, desirable to minimize the de-magnetizing force, in order to obtain the desired thrust with given volume and weight of the actuator. From this point of view, it is advisable to use, as the permanent magnet 53, a rare earth magnet having a $_BH_C$ value of 78ØØ Oe or greater, preferably an $RC_{05}$ rare earth magnet. These rare earth magnets exhibit higher maximum energy product and higher residual flux density than other magnets, so that it is possible to reduce the volume and weight of the actuator for obtaining an equal thrust.

An actuator constructed in accordance with another embodiment of the invention will be explained hereinunder with reference to FIG. 4 in which the same reference numerals are used to denote the same parts or members as those in the embodiment shown in FIG. 1. This embodiment is distinguished from the first embodiment by the construction of the end yokes 37a and 37b and the magnetic members 55a and 55b of the moving means 5. Namely, in this embodiment, the magnetic members 55a and 55b have a bottom-equipped hollow cylindrical form and have no tapered portion. The end yokes 37a and 37b, therefore, have uniform wall thickness. The coil bobbins 71a and 71b are provided with annular inward projections 73a and 73b made from the same electrically insulating material as the bobbins. These projections 73a and 73b project into the magnetic gaps 35a and 35b.

In the assembling of the actuator, the end portion 34 of the hollow cylindrical yoke member 31 is bend inwardly and caulked. In this embodiment, however, the strain caused by the caulking is effectively born by the projections 73a, 73b so that the distortion of the magnetic gaps 35a, 35b is effectively avoided.

Figure 4:
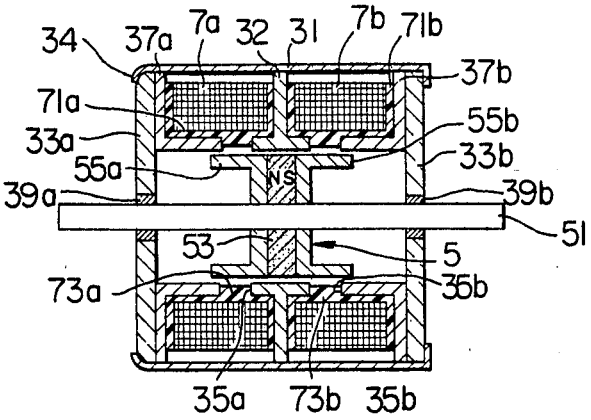
FIG. 4 is a longitudinal sectional view of an actuator for a door locking device, constructed in accordance with another embodiment of the invention.

In the embodiment shown in FIG. 4, the end walls 33a and 33b and the end yokes 37a and 37b are fabricated separately and then are united by screwing or the like measure to form the end yoke means. This, however, is not essential and the end walls and the end yokes may be integrated by welding as in the case of the embodiment shown in FIG. 1.

The first and second embodiments described heretofore are not exclusive and the invention can be carried out also in the following form.

Figure 5:
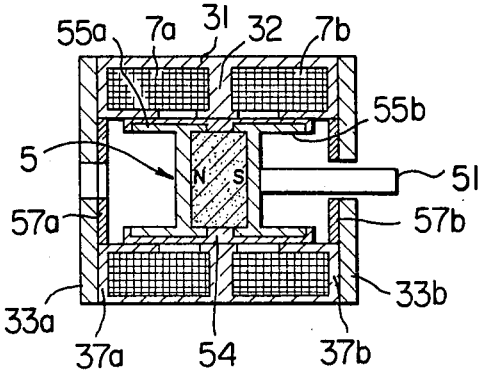
FIG. 5 is a longitudinal sectional view of an actuator for a door locking device, constructed in accordance with still another embodiment of the invention.
Figure 6A:
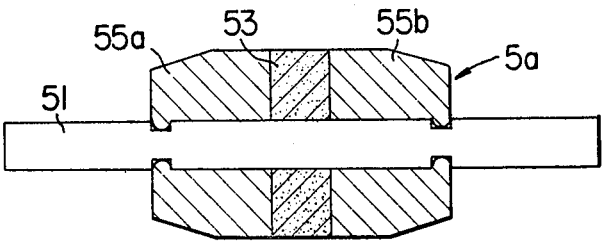
FIGS. 6A and 6B are sectional views of the modifications of the movable member incorporated in the actuator in accordance with the invention.
Figure 6B:
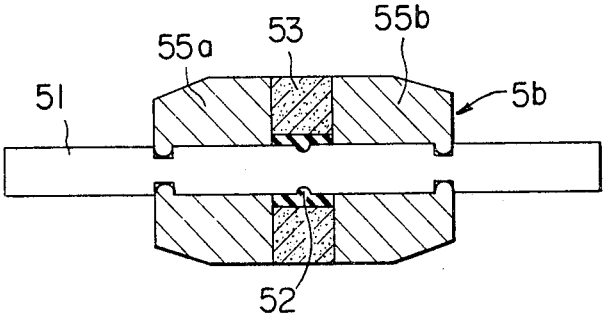

FIG. 5 shows an actuator constructed in accordance with a third embodiment of the invention in which, in contrast to the first embodiment having two bearings supporting the moving means 5, an annular bush 54 made of a self-lubricating metal is fitted around the moving means 5. The sliding surface of the bush 54 makes a sliding contact with the inner peripheral surface of the yoke apparatus 3. In this embodiment, the bearings for supporting the moving means 5 can be eliminated and the shaft 51 is required to project only from one end of the moving means 5.

In the embodiment of the invention shown in FIG. 5, an opening is formed in the end wall opposite to the projecting end of the shaft 51, so that the air is introduced to prevent excessive temperature rise of various parts of the actuator.

In this embodiment, the noise absorbing members 57*a* and 57*b* are attached not to the moving means but to the surfaces of the end walls 33*a* and 33*b* adjacent to the moving means.

As has been described, the present invention provides an actuator having the thrust-stroke characteristics suitable for actuating door locking devices for automobiles. In this actuator, the reciprocating motion of the moving means is caused by a simultaneous energization of two solenoid coils, so that the volume and weight of the actuator as a whole are remarkably reduced as compared with the conventional actuator in which the reciprocating motion of the moving means is caused by energizing two solenoid coils alternately. In addition, since the thrust acting on the moving means at the end of each stroke is reduced sufficiently, the level of the noise is lowered considerably to further enhance the utility of the actuator of the invention.

What is claimed is:

1. A direct current actuator for use in a vehicle door locking device, adapted to be operated by means of an electric switch, said actuator comprising:

a yoke apparatus having a hollow cylindrical yoke member, an annular center yoke member projecting inwardly from the middle inner peripheral surface of said cylindrical yoke member, a pair of end yoke means disposed in opposite end portions of said cylindrical yoke member to axially separate from said center yoke member to form a magnetic gap therebetween;

two annular solenoid coil means supported by said yoke apparatus therein and disposed axially separately in such a manner that the poles of the same polarity are generated in the adjacent end portions of said solenoid coils when they are energized; and a moving means disposed in a space defined by said yoke apparatus and having a predetermined annular gap between the periphery of said moving means and said yoke apparatus so as to reciprocate in said space, said moving means having an axially magnetized permanent magnet, a pair of magnetic members attached to the axially opposite ends of said permanent magnet, and a shaft engaging with said permanent magnet, each of said magnetic members including an annular portion attached to said permanent magnet and a tapered portion tapered toward the adjacent end of said actuator, and said end yoke means being so shaped as to be able to receive said tapered portion of said magnetic member.

2. An actuator as set forth in claim 1, wherein the following conditions (i) and (ii) are met:

$$A > C \text{ and } D > C \quad \text{(i)}$$

$$B \geqq C \geqq lg \quad \text{(ii)}$$

where,

A represents the axial distance between the end surfaces of said end yokes adjacent to said center yoke, B represents the axial length of the portion of said center yoke opposing to said moving means, C represents the axial length between the inner end surfaces of said magnetic members at the outer peripheral surface of said moving means, D represents the axial length between the end surfaces of said magnetic members adjacent to the ends of said actuator at the outer peripheral surface of said moving means, and lg represents the length of radial gap between the inner surface of said yoke apparatus and the outer peripheral surface of said moving means.

3. An actuator as set forth in claim 2, wherein the following condition (iii) is met:

$$0 \leqq (L/2) - (B - C)/2 \leqq 5[\text{mm}] \quad \text{(iii)}$$

where, L represents the length of the entire stroke of said moving means.

4. An actuator as claimed in claim 1, wherein said tapered portion has a tapered angle ranging between 5° and 25°.

5. An actuator as claimed in claim 1, wherein each of said solenoid coil means includes a solenoid coil and a coil bobbin made of an insulating material and accommodating said coil, said coil bobbin being provided with an inward projection engaging with said magnetic gap.

6. An actuator as claimed in claim 1, wherein a protecting means is provided on the outer peripheral surface of said permanent magnet of said moving means.

7. An actuator as claimed in claim 1, wherein bearing means engaging with the inner surface of said yoke apparatus is fixed to the outer peripheral surface of said moving means, thereby to support said moving means slidably on said yoke apparatus.

8. An actuator as claimed in claim 1, wherein said permanent magnet and said magnetic members of said moving means are provided with through bores, said shaft being received by said through bore of said permanent magnet with a spacer disposed between the outer peripheral surface of said shaft and the inner peripheral surface of said permanent magnet defining said through bore.

9. An actuator as claimed in claim 1, wherein said permanent magnet is a rare earth cobaltic magnetic having a $_BH_C$ value in excess of 78ØØ Oe.

10. A direct current actuator for use in a vehicle door locking device, adapted to be operated by means of an electric switch, said actuator comprising:

a yoke apparatus having a hollow cylindrical yoke member, an annular center yoke member projecting inwardly from the middle inner peripheral surface of said cylindrical yoke member, a pair of end yoke means disposed in opposite end portions of said cylindrical yoke member to axially separate from said center yoke member to form a magnetic gap therebetween;

two annular solenoid coil means supported by said yoke apparatus therein and disposed axially separately in such a manner that the poles of the same polarity are generated in the adjacent end portions of said solenoid coils when they are energized; and a moving means disposed in a space defined by said yoke apparatus and having a predetermined annular gap between the periphery of said moving means and said yoke apparatus so as to reciprocate in said space, said moving means having an axially magnetized permanent magnet, a pair of magnetic members attached to the axially opposite ends of said permanent magnet, and a shaft engaging with said permanent magnet, wherein the following conditions (i), (ii) and (iii) are met:

$$A > C \text{ and } D > C \quad \text{(i)}$$

$$B \geqq C \geqq lg \quad \text{(ii)}$$

$$0 \leqq (L/2) - (B - C)/2 \leqq 5[\text{mm}] \quad \text{(iii)}$$

where,

A represents the axial distance between the end surfaces of said end yokes adjacent to said center yoke, B represents the axial length of the portion of said center yoke opposing to said moving means, C represents the axial length between the inner end surfaces of said magnetic members at the outer peripheral surface of said moving means, D represents the axial length between the end surfaces of said magnetic members adjacent to the ends of said actuator at the outer peripheral surface of said moving means, lg represents the length of radial gap between the inner surface of said yoke apparatus and the outer peripheral surface of said moving means, and L represents the length of the entire stroke of said moving means.

11. An actuator as claimed in claim 10, wherein each of said magnetic members includes an annular portion attached to said permanent magnet and a tapered portion tapered toward the adjacent end of said actuator.

12. An actuator as claimed in claim 11, wherein said tapered portion has a tapered angle ranging between 5° and 25°.

13. An actuator as claimed in claim 10, wherein each of said solenoid coil means includes a solenoid coil and a coil bobbin made of an insulating material and accommodating said coil, said coil bobbin being provided with an inward projection engaging with said magnetic gap.

14. An actuator as claimed in claim 10, wherein a protecting means is provided on the outer peripheral surface of said permanent magnet of said moving means.

15. An actuator as claimed in claim 10, wherein bearing means engaging with the inner surface of said yoke apparatus is fixed to the outer peripheral surface of said moving means, thereby to support said moving means slidably on said yoke apparatus.

16. An actuator as claimed in claim 10, wherein said permanent magnet and said magnetic members of said moving means are provided with through bores, said shaft being received by said through bore of said permanent magnet with a spacer disposed between the outer peripheral surface of said shaft and the inner peripheral surface of said permanent magnet defining said through bore.

17. An actuator as claimed in claim 10, wherein said permanent magnet is a rare earth cobaltic magnet having a $_BH_C$ value in excess of 78ØØ Oe.

* * * * *